US011267494B2

(12) United States Patent
Shirvani et al.

(10) Patent No.: US 11,267,494 B2
(45) Date of Patent: Mar. 8, 2022

(54) MULTI-RAIL EXPRESS TRANSIT SYSTEM

(71) Applicants: Mansour Shirvani, Tehran (IR); Mohammad Hamid Derakhshan, Tehran (IR)

(72) Inventors: Mansour Shirvani, Tehran (IR); Mohammad Hamid Derakhshan, Tehran (IR)

( * ) Notice: Subject to any disclaimer, the term of this patent is extended or adjusted under 35 U.S.C. 154(b) by 293 days.

(21) Appl. No.: 16/699,175

(22) Filed: Nov. 29, 2019

(65) Prior Publication Data

US 2021/0163049 A1 Jun. 3, 2021

(51) Int. Cl.

| | |
|---|---|
| ***B61K 1/00*** | (2006.01) |
| ***B61D 3/04*** | (2006.01) |
| ***B61D 19/02*** | (2006.01) |
| ***B61B 1/02*** | (2006.01) |

(52) U.S. Cl.

CPC ..... *B61K 1/00* (2013.01); *B61B 1/02* (2013.01); *B61D 3/04* (2013.01); *B61D 19/026* (2013.01)

(58) Field of Classification Search

CPC .... B61K 1/00; B61K 1/02; B61B 1/02; B61D 3/04; B61D 19/026; B61L 27/0038; B61L 15/0072; B61L 15/009; B61L 25/028; B61L 25/021; B61L 3/127

See application file for complete search history.

(56) References Cited

U.S. PATENT DOCUMENTS

| | | | | |
|---|---|---|---|---|
| 437,729 | A * | 10/1890 | Solano | B61D 17/20 105/11 |
| 3,958,512 | A * | 5/1976 | Stankiewicz | B61K 1/00 104/20 |
| 4,018,410 | A * | 4/1977 | Renaux | B61B 13/00 705/7.12 |
| 7,225,896 | B2 * | 6/2007 | Broad | E06C 7/182 105/443 |
| 2004/0245410 | A1 * | 12/2004 | Kisak | B61L 15/0036 246/3 |
| 2008/0276832 | A1 * | 11/2008 | Chisena | B61D 23/025 105/458 |

FOREIGN PATENT DOCUMENTS

| | | | | |
|---|---|---|---|---|
| CN | 109229135 | A * | 1/2019 | |
| GB | 2514143 | A * | 11/2014 | B61L 27/0094 |
| WO | WO-9406527 | A1 * | 3/1994 | A63H 19/16 |

* cited by examiner

*Primary Examiner* — Mark T Le

(57) ABSTRACT

A multi-rail express transit system for allowing the passengers to travel at desired speed/distance, is disclosed. The system comprises a centralized control system, at least three closed loop parallel rails, and at least three sequence of transit cars. Each sequence of transit car is supported by the respective rail. The transit cars are configured to move in same direction at different speeds. The control system is configured to synchronize the speed of transit cars at desired point to allow transference of passengers. A bellow assembly is disposed around an exterior side of a door of each transit car. The bellow assembly is configured to form an airtight passageway between at least two transit cars. Each transit car comprises a movable floor. The movable floor of one transit car is extendable to a floor of an adjacent transit car to facilitate passenger transference on forming the airtight seal.

3 Claims, 6 Drawing Sheets

MULTI-RAIL EXPRESS TRANSIT SYSTEM

BACKGROUND OF THE INVENTION

A predominant problem of the transportation system of larger urban areas is traffic congestion, which creates more extra travel time than in the past. Within the transportation system such as taxi, bus and other forms of public transportation, metro stands out as the most manageable means with the highest capacity for carrying passengers. The advantages of a city metro network includes: high capacity of carrying passengers using a mass transportation mechanism; reduction in use of fossil fuel and air pollution, particularly in populated cities; higher average speed in comparison with bus or taxi that have to go through traffic paths and stoplights; higher security for passengers; reduction in noise pollution that vehicles produce; aids in coordination and management of city public transportation; and creation of a clean and well-ordered atmosphere for transportation routes.

However, despite these advantages and benefits of the metro network, there is a great disadvantage, which is the speed limit due to continuous stopping for embarking and disembarking of passengers within short proximity of stations. At present, most of the highly populated cities of the world have been able to use the metro to partially resolve their transportation, traffic and pollution problems. Therefore, we can confidently say without metro networks, the large and highly populated cities of the world would face significant traffic problems and disastrous air pollution. Considering the continuous growth in large and populated cities and the increasing demands of inhabitants for far-reaching distances, the matter of the need for a metro network with higher average speeds is more and more becoming a tremendous demand.

However, the existing systems lack an efficient express transit system that could adapt to the increasing demands of inhabitants. Therefore, there is a need for a multi-rail express transit system for allowing the passengers to travel to any desired distances without any stoppage for the passengers embarking and disembarking. Further, there is a need for a multi-rail express transit system that allows to add new transit lines to the existing express transit system for extending a network of the multi-rail express transit system for increase in the population and the area of cities as they grow.

SUMMARY OF THE INVENTION

Herein disclosed is a multi-rail express transit system for allowing the passengers to travel at any desired distances without any stoppage for the passengers embarking and disembarking.

In one embodiment, the system comprises a centralized control system, at least three closed loop parallel rails, and at least three sequence of transit cars. Each sequence of transit car is supported by the respective rail. The at least three sequence of transit cars are configured to move in the same direction at different speeds. The centralized control system is configured to synchronize the speed of at least two sequence of transit cars at a desired point to allow transference of one or more passengers between the at least two sequence of transit cars.

The multi-rail express transit system further comprises one or more transmitting sensors installed at intervals of rails. The transmitting sensors are in communication with the centralized control system. The transmitting sensors are configured to transmit signal related to speed and location associated with time of each transit car to the centralized control system. Each transit car comprises a digital device in communication with the centralized control system. The digital device is configured to display and announce the location information of passengers, time to start changing transit cars, and allow passengers to select their desired stop. The multi-rail express transit system further comprises a bellow assembly disposed around a door of each transit car, at an exterior side. The bellow assembly is in communication with the centralized control system. The bellow assembly comprises a bellow type-sealing member, a magnetic clamp and a bellow expander operated using two or more hydraulic actuators.

The magnetic clamp is disposed at an end of the bellow-type sealing member to tightly clip around a door of an adjacent transit car. Each transit car comprises a movable floor in communication with the centralized control system. The movable floor of one transit car is extendable to a floor of an adjacent transit car. The centralized control system is further configured to clamp the bellow type-sealing member of at least one transit car to at least one adjacent transit car using the magnetic clamp to form an airtight passageway there-between.

The centralized control system is further configured to open a door of the at least one transit car and the adjacent transit car. The centralized control system is configured to extend the movable floor of the at least one transit car to a floor of the adjacent transit car for the transference of passengers. The movable floor comprises one or more holding bars. The holding bars are configured to provide support to the passengers. The centralized control system is further configured to retract the movable floor to the at least one transit car and closes the door of the at least one transit car and the adjacent transit car, after transference of passengers. The centralized control system is configured to retract the bellow assembly to a compact position using the bellow expander.

In yet another embodiment, the system comprises a centralized control system, at least three closed loop parallel rails, at least three sequence of transit cars, and a bellow assembly. Each sequence of transit car supported by the respective rail are configured to move in same direction at different speeds. The bellow assembly is disposed around an exterior side of a door of each transit car. The bellow assembly is in communication with the centralized control system. The bellow assembly comprises a bellow type-sealing member, a magnetic clamp and a bellow expander operated using two or more hydraulic actuators.

The centralized control system is configured to synchronize the speed of at least two sequence of transit cars at a desired point to allow transference of one or more passengers. The centralized control system is further configured to clamp the bellow type-sealing member of at least one transit car to at least one adjacent transit car using the magnetic clamp to form an airtight passageway there-between. The centralized control system is further configured to open a door of the at least one transit car and the adjacent transit car. The centralized control system is further configured to extend the movable floor of the at least one transit car to a floor of the adjacent transit car for the transference of passengers. The centralized control system is further configured to retract the movable floor to the at least one transit car and closes the door of the at least one transit car and the adjacent transit car, after transference of passengers. The centralized control system is further configured to retract the bellow assembly to a compact position using the bellow expander.

One aspect of the present disclosure is directed to a multi-rail express transit system, comprising: a centralized control system; at least three closed loop parallel rails, and at least three sequence of transit cars, wherein each sequence of transit car is supported by the respective rail, wherein the at least three sequence of transit cars are configured to move in same direction at different speeds, wherein the centralized control system is configured to synchronize the speed of at least two sequence of transit cars at a desired point to allow transference of one or more passengers between the at least two sequence of transit cars.

In one embodiment, the multi-rail express transit system further comprises one or more transmitting sensors installed at intervals of rails, wherein the transmitting sensors are in communication with the centralized control system, and wherein the transmitting sensors are configured to transmit signal related to speed and location associated with time of each transit cars to the centralized control system. In another embodiment, each transit car comprises a digital device in communication with the centralized control system, wherein the digital device is configured to display and announce the location information of passengers, time to start changing transit cars, and allow passengers to select their desired stop.

In one embodiment, the multi-rail express transit system further comprises a bellow assembly disposed around a door of each transit car, at an exterior side, wherein the bellow assembly is in communication with the centralized control system, and wherein the bellow assembly comprises a bellow type-sealing member, a magnetic clamp and a bellow expander operated using two or more hydraulic actuators. In another embodiment, the magnetic clamp is disposed at an end of the bellow-type sealing member to tightly clip around a door of an adjacent transit car. In another embodiment, each transit car comprises a movable floor in communication with the centralized control system. In one embodiment, the movable floor of one transit car is extendable to a floor of an adjacent transit car.

In one embodiment, in the multi-rail express transit system, the centralized control system is configured to: clamp the bellow type-sealing member of at least one transit car to at least one adjacent transit car using the magnetic clamp to form an airtight passageway there-between; open a door of the at least one transit car and the adjacent transit car; extend the movable floor of the at least one transit car to a floor of the adjacent transit car for the transference of passengers, wherein the movable floor comprises one or more holding bars; retract the movable floor to the at least one transit car and closes the door of the at least one transit car and the adjacent transit car, after transference of passengers; and retract the bellow assembly to a compact position using the bellow expander. In one embodiment, the holding bars are configured to provide support to the passengers.

Another aspect of the present disclosure is directed to a multi-rail express transit system, comprising: a centralized control system; at least three closed loop parallel rails; at least three sequence of transit cars, wherein each sequence of transit car is supported by the respective rail, wherein the at least three sequence of transit cars are configured to move in same direction at different speeds; and a bellow assembly disposed around an exterior side of a door of each transit car, wherein the bellow assembly is in communication with the centralized control system, wherein the bellow assembly comprises a bellow type-sealing member, a magnetic clamp and a bellow expander operated using two or more hydraulic actuators, wherein the centralized control system is configured to: synchronize the speed of at least two sequence of transit cars at a desired point to allow transference of one or more passengers; clamp the bellow type-sealing member of at least one transit car to at least one adjacent transit car using the magnetic clamp to form an airtight passageway there-between; open a door of the at least one transit car and the adjacent transit car; extend the movable floor of the at least one transit car to a floor of the adjacent transit car for the transference of passengers, wherein the movable floor comprises a holding bar; retract the movable floor to the at least one transit car and closes the door of the at least one transit car and the adjacent transit car, after transference of passengers; and retract the bellow assembly to a compact position using the bellow expander.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION

The present invention generally relates to a rail transit system and more particularly relates to a multi-rail express transit system for allowing the passengers to travel at any desired distances without any stoppage for the passengers embarking and disembarking.

A description of embodiments of the present invention will now be given with reference to the figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1:
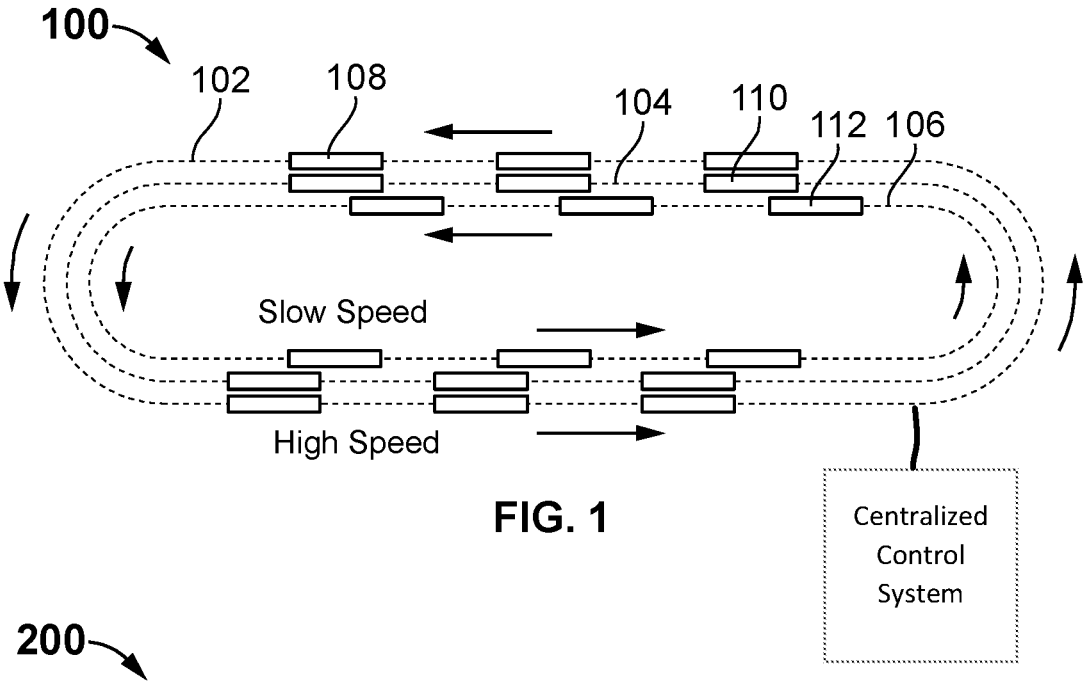
FIG. 1 exemplarily illustrates a multi-rail express transit system, according to an embodiment of the present invention.

Referring to FIG. 1, the present invention discloses a multi-rail express transit system 100. The system 100 comprises a centralized control system and a transit line. The transit line comprises at least three closed loop parallel rails and at least three sequence of transit cars. The at least three sequential transit cars comprise a first sequence of transit car 112, a second sequence of transit car 110 and a third sequence of transit car 108. The at least three parallel rails comprise a first rail 106, a second rail 104 and a third rail 102. Each sequence of transit car is supported by a respective rail. The at least three sequence of transit cars are configured to travel continuously with a fixed distance between each other, in one direction and with different speeds.

The centralized control system is configured to control the at least three sequence of transit cars. The centralized control system is configured to adjust and control the movement of the at least three sequential transit cars at a desired time for the at least three sequence of transit cars on different rails to reach equivalent speeds in some specific time durations. At such times, the centralized control system is configured to open the doors of the transit cars for the transference of passengers to adjacent rails. During variation of the speed of cars on different rails, the passengers could select their speed of travel in respect to the speed of the car. The passenger could increase his speed on entering the transit car that is configured to move at higher speed or could decrease his speed on entering the transit car that is configured to move at lower speed.

Figure 2:
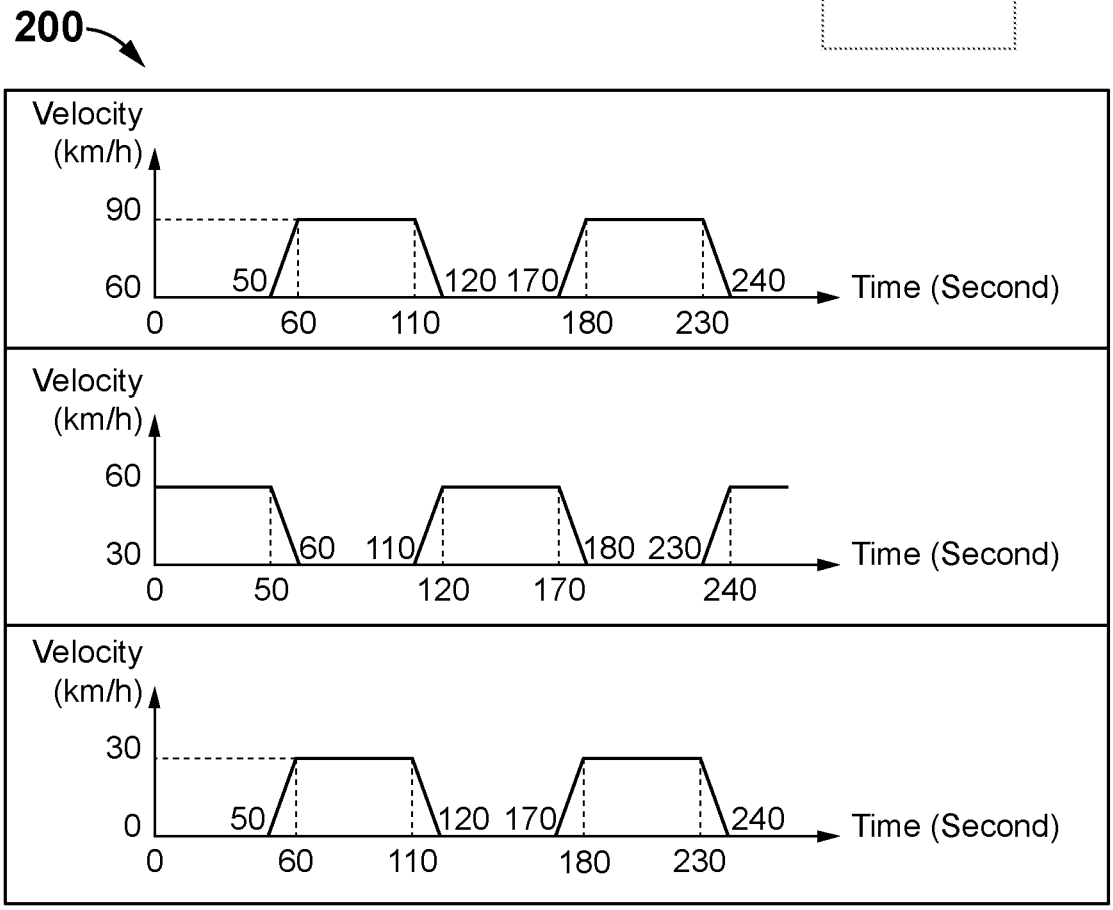
FIG. 2 exemplarily illustrates a timetable of movement of transit cars on each rail of FIG. 1, according to an embodiment of the present invention.

The operation of the system 100 is disclosed in detail with respect to FIG. 2. The figure shows the timetable of movement 200 of transit cars on each rail. The variations of the speeds of the at least three sequence of transit cars on all of the rails are periodic and arranged as to provide the displacement of passengers between rails. For example, the first sequence of transit car 112 is configured to move at low speed on the first rail 106, the second sequence of transit car 110 is configured to move at medium speed on the second rail 104 and the third sequence of transit car 108 is configured to move at high speed on the third rail 102.

The ranges of speeds for the first sequence of transit car 112, the second sequence of transit car 110, and the third sequence of transit car 108 are selected to be 0 to 30, 30 to 60 and 60 to 90 km per hour. Hereinafter, the first sequence of transit car 112 is also represented as low speed car, the second sequence of transit car 110 is also represented as medium speed car, the third sequence of transit car 108 is also represented as high speed car, the first rail 106 is also represented as low speed rail, the second rail 104 is also represented as medium speed rail, and the third rail 102 is also represented as high speed rail.

According to the present invention, the selected ranges of speeds could be higher or lower. From FIG. 2, the periods of speed variation are designed such that when the first transit sequence of car 112 is stopped for embarking and disembarking of passengers, the second sequence of transit car 110 and third sequence of transit cars 108 are configured to move at 60 km per hour. Therefore, passengers could transfer between medium-speed car and high-speed car, i.e., transferring from the car on one rail to another car on the other rail, whether the passenger wants to continue his travel slower or faster. In the next stage of variation of the speed of cars; the first sequence of transit car 112 increase their speed up to 30 km per hour, while the second sequence of transit car 110 decrease their speed to reach to the same speed of 30 km per hour to allow the passengers transference on second sequence of transit car 110 and first sequence of transit car 112 for changing their speed.

During this period the third sequence of transit car 108 is configured to increase their speed to the maximum 90 km per hour. The above periodical variations of speeds will repeat again and again in subsequent time intervals. In this way, the conditions of simultaneous increasing and decreasing of the speed, as well as embarking and disembarking for all passengers is provided without any disturbance between each other. Any passenger could gradually change his speed and travel a long distance at the average speed of 75 km per hour without delay and not being affected by stops for other passengers. Therefore, passengers, according to their requirements and the length of their travel, could choose their correct rail to travel on and prepare to get off at their destination.

One aspect of the present disclosure is a multi-rail express transit system, comprising: a centralized control system; at least three closed loop parallel rails, and at least three sequence of transit cars, wherein each sequence of transit car is supported by the respective rail. The at least three sequence of transit cars may be configured to move in same direction at different speeds, and the centralized control system may be configured to synchronize the speed of at least two sequence of transit cars at a desired point to allow transference of one or more passengers between the at least two sequence of transit cars.

With the above selected speeds on the at least three rails, the medium speeds for the three rails of low, medium and high speed are 15, 45, and 75 km per hour, respectively. Now, if, for example, increase the range of speed variations of the at least three sequence of transit cars equal to 0-50, 50-100 and 100-150 km per hour, then the average speeds would increase to 25, 75, 125 km per hour. Therefore, it can be assumed the approximate speed of the at least three sequence of transit cars would be around 75 km per hour. This speed is about twice the average speed of trains that are in normal operation in conventional metro systems in the world today.

Accordingly, the increase in speed means an increase in volume capacity of passengers without increasing the number of transit cars, which is an economical benefit. The speeds and the distance gap between the at least three sequence of transit cars on the rails are controlled by the centralized control system so that the at least three sequence of transit cars travel individually without any linkage to each other. In this way, depending on the required capacity and crowding condition of passengers, any number of cars could be used on the rails. It would even be possible that the gaps between the cars eliminated and all the rails become full of cars. This is another advantage of the present invention in addition to its no delay without stops for passengers embarking and disembarking.

According to the present invention, each transit car comprises a digital device to announce and display the passenger's position information and appropriate time (or location) to start changing rail, allowing passengers to select and to prepare for their desired stop. The digital device aids the passenger to prevent missing of their step station during traveling at high, medium or low speeds. In one embodiment, the digital device could be a display device, audio device or any other type of device suitable for communication.

Figure 3:
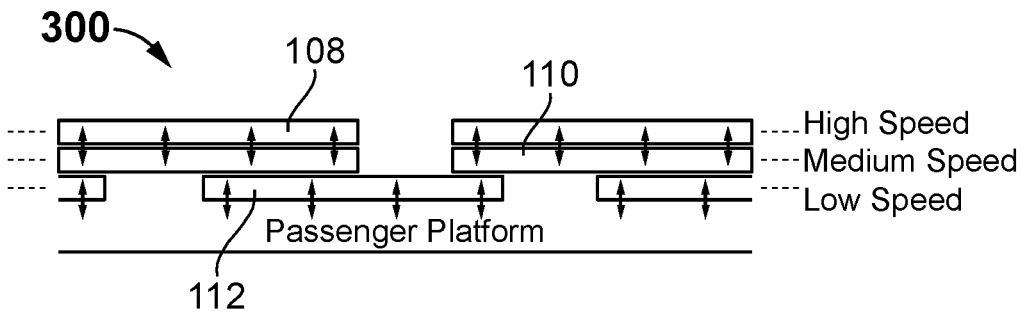
FIG. 3 exemplarily illustrates the third and second sequence of transit cars travelling at same speed exchanging passengers, while the first sequence of transit car at rest, according to an embodiment of the present invention.
Figure 4:
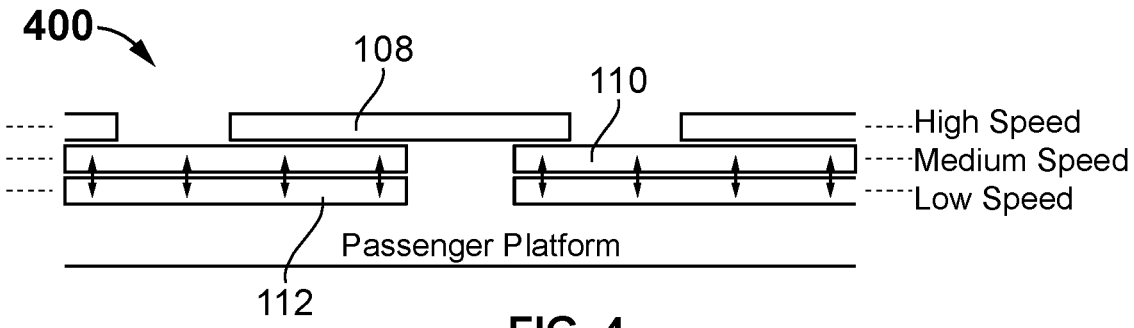
FIG. 4 exemplarily illustrates a second sequence of transit car and a first sequence of transit car travelling at same speed and exchanging passengers, while the third sequence of transit car moving at a maximum speed, according to an embodiment of the present invention.

Referring to FIG. 3, a scenario 300, where the third transit sequence of car 108 and second sequence of transit car 110 travelling at same speed exchanging passengers, while the first sequence of transit car 112 at rest, according to an embodiment of the present invention. Referring to FIG. 4, a scenario 400, where the second sequence of transit car 110 and the first sequence of transit car 112 travelling at same speed and exchanging passengers, while the third sequence of transit car 108 moving at a maximum speed, according to an embodiment of the present invention.

Figure 5:
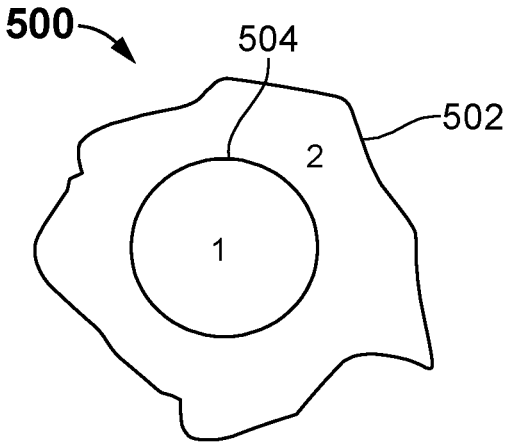
FIG. 5 exemplarily illustrates a division of transportation population into two sections with a connection from every direction in a circular configured transit line, according to an embodiment of the present invention.
Figure 6:
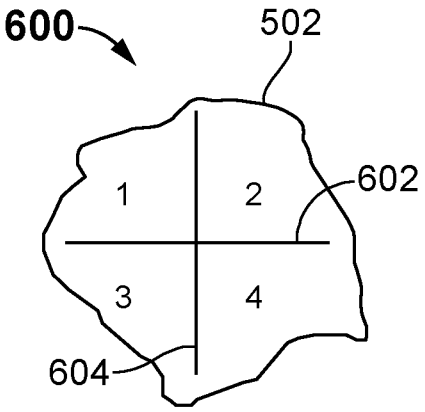
FIG. 6 exemplarily illustrates a division of transportation of population of four smaller transporting sections with the aid of two intersecting transit lines, according to an embodiment of the present invention.
Figure 7:
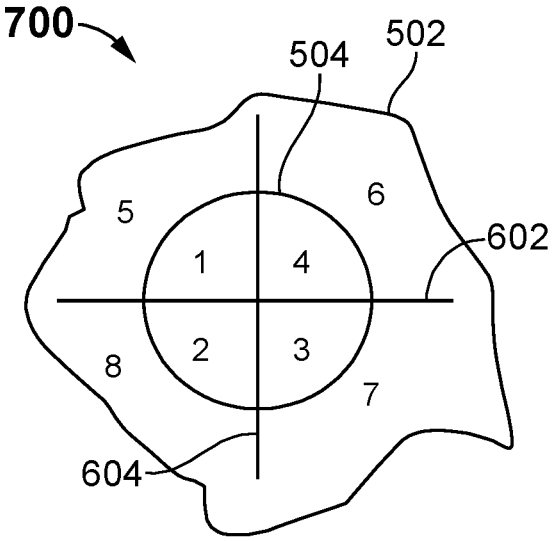
FIG. 7 exemplarily illustrates a division of the transportation population into eight small sections with two intersecting loop-type transit lines and one circle-type transit line, according to an embodiment of the present invention.

Referring to FIG. 5 to FIG. 8, configurations comprising a plurality of transit line, which divides a city into smaller transportation areas are disclosed. Referring to FIG. 5, a model 500 of a circular transit line 504 dividing a city 502 into two smaller transportation area is disclosed. Metro, bus, and taxi could help in the transportation of passengers in each area and to access the circular transit line 504. Referring to FIG. 6, a model 600 of at least two intersecting transit lines (602, 604) dividing the city 502 into four transportation regions is disclosed. Referring to FIG. 7, a combination 700 of the designs in FIG. 5 and FIG. 6 is proposed to divide the city into much smaller transportation regions with better access of the passengers to the transit lines (602, 604, 504). At least two intersecting loop-type transit lines (602, 604) and one circle-type transit line 504 divides the city 502 into smaller transportation area.

Figure 8:
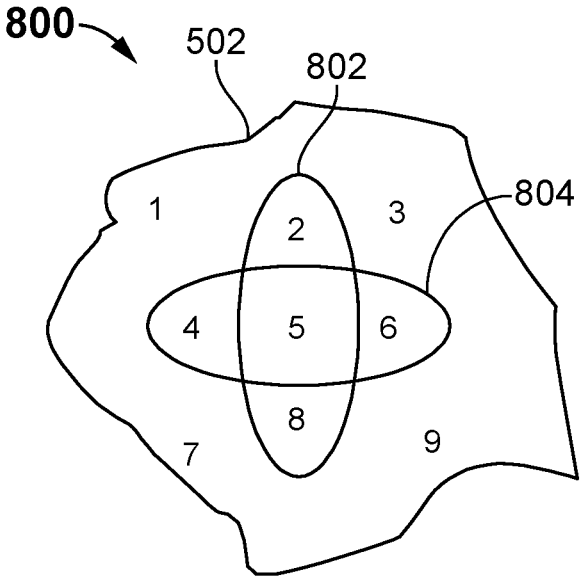
FIG. 8 exemplarily illustrates a division of the transportation population into nine small sections utilizing two intersecting oval configured transit lines, according to an embodiment of the present invention.

Referring to FIG. 8, a model 800 of at least two intersecting oval-type transit lines (802, 804) dividing the city 800 into small transportation regions is disclosed. The lines (802, 804) are not linked to each other. The passengers need to disembark from their respective line (802, 804) and embark a desired line (802, 804) to reach a desired region.

Figure 9:
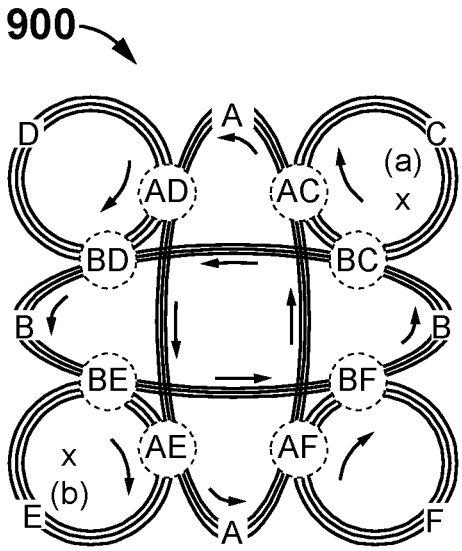
FIG. 9 exemplarily illustrates a network of transit lines allowing the passengers to travel far distances in maximum speed without stoppage for other passengers, according to one embodiment.

FIG. 9 exemplarily illustrates a network 900 of transit lines allowing the passengers to travel far distances in maximum speed without stoppage for other passengers, according to one embodiment. The network 900 allows passengers to transfer between lines at their maximum speed without embarking or disembarking from the line in which they are traveling. Four lines including lines: C, D, E, and F are added to the crossing lines A and B, such that adjacent and same speed movement of the high speed transit cars (third sequence of transit cars 108) in two different lines at specific regions like AC, AD, BD, BE, AE, AF, BF, and BC are accomplished. The A and B lines are chosen to travel counterclockwise; and C, B, E, and F lines are chosen to travel in a clockwise direction, for unidirectional movement of transit cars. The third sequence of transit cars 108 are travelling at the outer loop on each line, which enables the passengers to transfer between the lines at maximum speed when the cars come to equal-speeds at the above-mentioned specific regions.

For example, a passenger in point (a) wants to go to point (b). He can embark line C and change his line at equal-speed at region AC to continue his travel by line A and again change line at equal-speed region AE to come to line E and continue to get off the network at the desired point to go to (b). In another path, the above passenger can change lines from C to B and then line E to do the same travel and reach the same point (b). Accordingly, the network 900 connects all the transit lines to each other to enable a passenger on any line to travel at maximum speed of the network up to the point of his destination.

Figure 10:
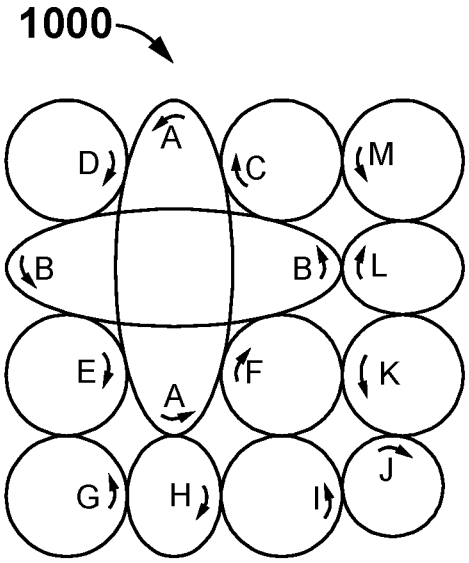
FIG. 10 exemplarily illustrates an extended network formed by the addition of one or more lines to a network of FIG. 9, according to an embodiment of the present invention.

FIG. 10 exemplarily illustrates an extended network 1000 formed by the addition of one or more lines to the network 900 of FIG. 9, according to an embodiment of the present invention. One or more lines are added to the network 1000, due to extension of city area, which may lead to address a problem of the severe difference between the crowds of passengers on two adjacent lines. For example, line B is experiencing severe passengers density compared to line L, since line B covers the central areas of the city, while the line L covers the peripheral areas of the city. In this case, it is not economical to use the same number of cars per km in line L as is used in line B. Such problems can simply be resolved by reducing the number of cars (car density) in line L to half the number of cars per km in comparison to line B. That is for every two cars in line B one car is used in service in line L. So, the travel of cars should be programmed as needed.

Figure 11:
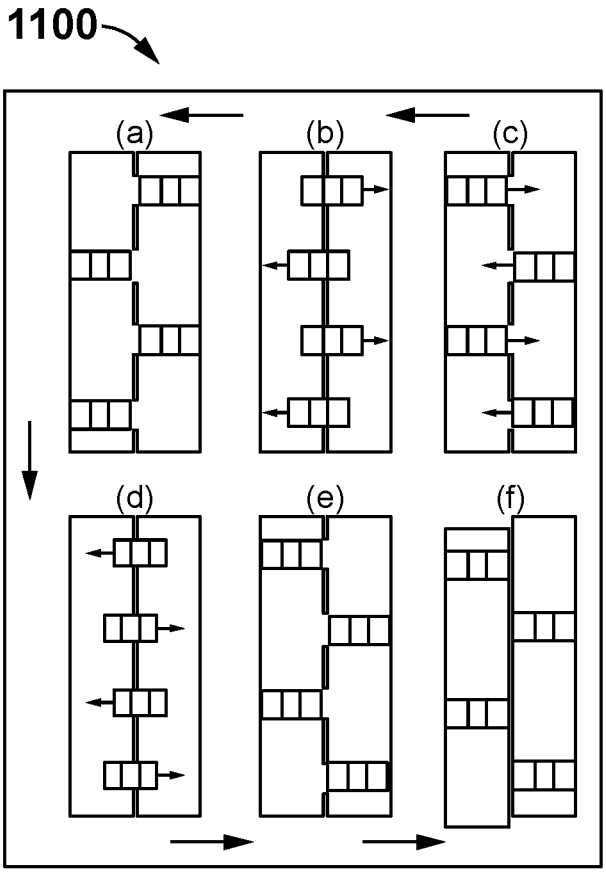
FIG. 11 exemplarily illustrates a sequence of transference of passengers in groups by displacing floors, according to an embodiment of the present invention.

FIG. 11 exemplarily illustrates a sequence 1100 of transference of passengers in groups by displacing floors, according to an embodiment of the present invention. Each transit car comprises a movable floor 1208 (shown FIG. 12) in communication with the centralized control system. The movable floor 1208 is configured to carry the passenger from one transit car to another transit car. The movable floor 1208 is configured to move and displace the passengers in a group from car to car on different lines or different rails. Still referring to FIG. 11, the complete sequence 1100 of passengers transfer between cars is explained in six steps from (a) to (f) for two adjacent cars which are moving at the same speed. As shown in the figure, two doors of each car are used for moving floors from a left transit car to right transit car and two doors for moving floors from right to left.

When the doors are fully opened, the floors start moving slowly to transfer the passengers between the cars with the passengers standing on them, ready to be displaced, with two floors from left to right and two floors from right to left car, simultaneously. In step (a), the doors are shown fully opened and the floors are ready to start moving. In step (b), the moving floors are shown as they are passing through the doors, with the passengers standing on them while holding a horizontal bar as their handles. In step (c), the moving floors are shown as they have changed their cars to the adjacent one, perfectly. In the next stage, the floors should come back to their initial position, to become ready for transferring another group of passengers. So, after the passengers have gotten off the floors, some new passengers who want to displace from their cars get on the floors, ready to be displaced with the floors during returning back to their initial position. In this way, during returning back the floors displace some new passengers. The returning back of floors is shown in FIG. 11.

Thus, in each complete period of passenger displacement between the cars, four times the area of one floor is displaced from each car to another car. Step (e) shows the end of one cycle of movement of the moving floors, with which a considerable number of passengers have been transferred both from left to right and right to left side. In step (f), the doors are closed and the at least two sequence of transit cars started to increase or decrease their speeds in order to start the next cycle of exchanging the passengers in another cycle of equal speeding of cars. Without using the floors there may appear serious dangerous conditions in which a stampede condition of transferring passengers may occur around the doors and this is very dangerous. As shown in FIG. 11, horizontal handle bars are provided for passengers to help them keep standing and preventing them to move around, while standing on the floor.

Figure 12:
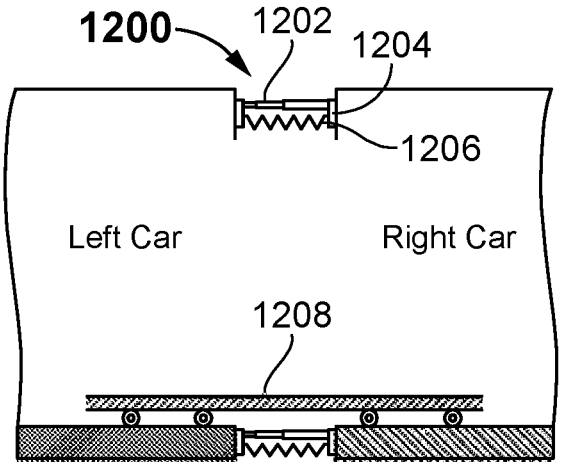
FIG. 12 exemplarily illustrates a bellow assembly according to an embodiment of the present invention.

FIG. 12 exemplarily illustrates a bellow assembly 1200 of the system 100 according to an embodiment of the present invention. The assembly comprises a bellow type-sealing member 1206, a magnetic clamp 1204 and a bellow expander 1202 operated using two or more hydraulic actuators. FIG. 12 further shows a schematic longitudinal side view of two transit cars with bellow type-sealing member 1206 in clamped position, while the movable floor 1208 is moving through the door. This figure shows, only, the top and bottom sections of bellow type-sealing member 1206. However, the bellow type-sealing member 1206 is all around the door to form an airtight seal. After complete transfer of the passengers, the doors are configured to close. Thereafter, the magnetic clamp 1204 opens and the hydraulic actuators close the bellow type-sealing member 1206 to a compact position providing a suitable condition for the speed variation of the cars.

One aspect of the present disclosure is directed to a multi-rail express transit system, comprising: a centralized control system; at least three closed loop parallel rails; at least three sequence of transit cars are configured to move in same direction at different speeds, wherein each sequence of transit car is supported by the respective rail, and a bellow assembly disposed around an exterior side of a door of each transit car, wherein the bellow assembly is in communication with the centralized control system, wherein the bellow assembly comprises a bellow type-sealing member, a magnetic clamp and a bellow expander operated using two or more hydraulic actuators, wherein the centralized control system is configured to: synchronize the speed of at least two sequence of transit cars at a desired point to allow transference of one or more passengers; clamp the bellow type-sealing member of at least one transit car to at least one adjacent transit car using the magnetic clamp to form an airtight passageway there-between; open a door of the at least one transit car and the adjacent transit car; extend the movable floor of the at least one transit car to a floor of the adjacent transit car for the transference of passengers, wherein the movable floor comprises a holding bar; retract the movable floor to the at least one transit car and closes the door of the at least one transit car and the adjacent transit car, after transference of passengers, and retract the bellow assembly to a compact position using the bellow expander.

Figure 13:
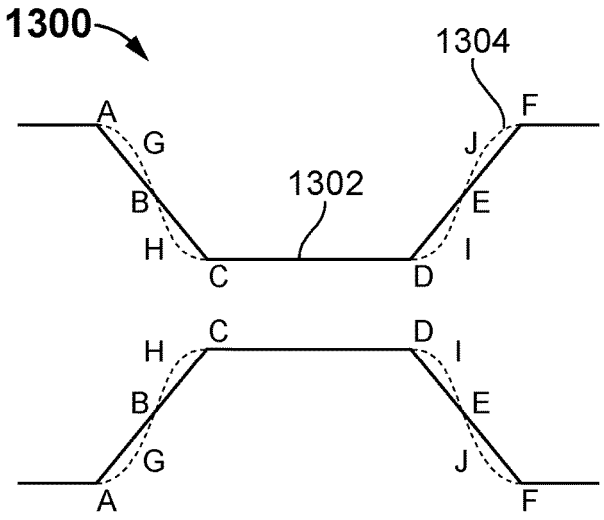
FIG. 13 exemplarily illustrates a graph of practical speed variation of transit cars to achieve the required time-plan of speed equalization of the transit cars, according to an embodiment of the present invention.

Referring to FIG. 13, a graph 1300 of a practical speed variation of transit cars to achieve the required time-plan of speed equalization of the sequence of transit cars is disclosed. The graph 1300 shows the practical paths of speed variations in comparison to FIG. 2. The figure is drawn for adjacent cars during the time they are going to reach to equal speeds. The path A-B-C-D-E-F is the non-practical path 1302 in which the sudden change of speed is obtained, while the path of dashed line A-G-B-H-C-D-I-E-J-F is the practical controlled path 1304 with an increased slope of speed variations and smoothed changes near the corners, where the cars reach to the equal speeds.

Figure 14:
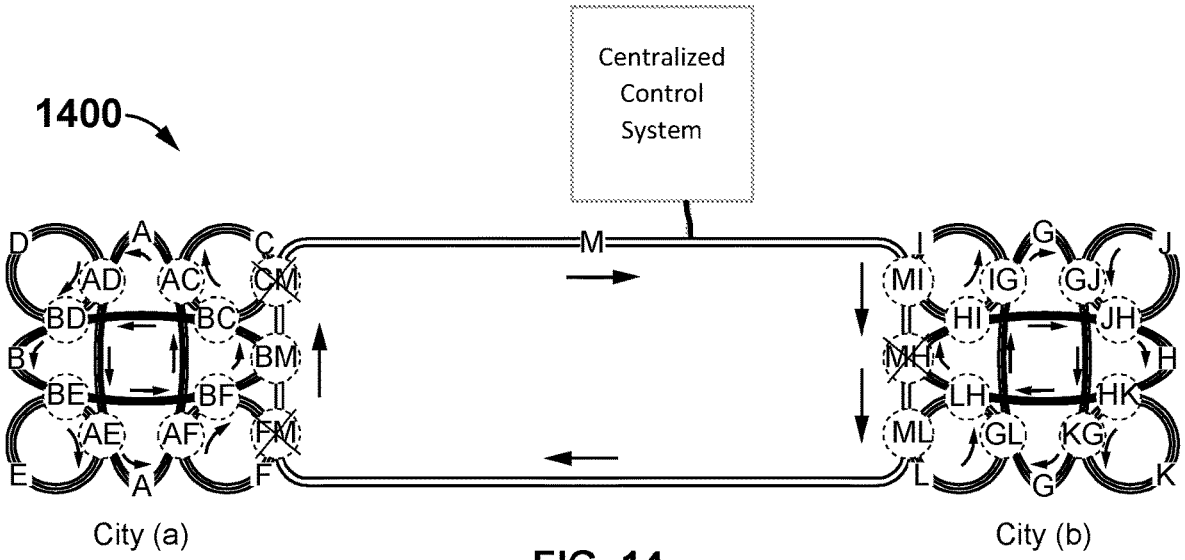
FIG. 14 exemplarily illustrates an interconnected network connecting at least two networks via an express connection transit line, according to an embodiment of the present invention.

FIG. 14 exemplarily illustrates an interconnected network 1400 connecting at least two networks of two nearby cities via an express connection transit line, according to an embodiment of the present invention. FIG. 14 shows a prototype example of the interconnected network 1400. The moving direction of the two networks in the cities is in counter-direction with respect to each other, to provide the suitable condition for the passenger transferring between the medium line M and the two networks in the cities. The locations BM, MI and ML are the points of equalization of the speeds of the high speed cars for passenger transferring between line M and city networks. While, the locations CM, FM and MH are not usable for passenger transferring between lines due to counter-direction of moving cars. Therefore, while the line M provides service to the citizens between the two cities, it connects the networks of the two cities in an express manner.

Due to low population density between the two cities, the line M is proposed here with two rail loops, while it may be designed with three rail loops if required. The cars in line M can increase their speed in the regions far from the cities, since the passenger crowd is much lower than the crowded cities. The increased velocity of cars between the cities means increased controlled distance between the cars in moving and increased distance between subsequent stations. Also, the reduced number of loops means requiring increased velocities of the cars to attain the desired maximum speed. This in turn increases the distances between stations located between the cities.

The advantages of the present invention are explained as follows. The present invention provides a way of transporting passengers to farther distances at higher speed. According to the present invention, the passengers do not need to stop for the embarking and disembarking process of other passengers. Therefore, people could travel at a higher speed from any point to any other point in the network, at a maximum speed. This system 100 works with the movement of cars in one direction with rails being parallel to each other which are programmable at a controlled speed and distance with each other while in motion. In this way, passengers could change their speed of travel and line, while transferring at these designated points, from one car to another which are moving at the same speed. Using this technique, maximum speed could be attained. In addition, the capacity of adding cars to lines is more efficient than traditional metro systems. The advantage of this system 100 in cities with growing populations is extremely beneficial and efficient.

According to the present invention, the system 100 demonstrates the following advantages: (1) Increasing the average speed of traveling of passengers would increase passenger population capacity of cars. A simple calculation shows in a 25 km line of system 100 that consists three rails with fully equipped with cars connected to each other and assuming, rails are in operation for 17 hours daily working time, approximately 20 million passengers could be transported in a maximum estimation. Of course, such capacity is never needed in any part of any city. The cars must move within a specific required and controlled distance with each other.

Movement of cars at a controlled speed and specified distance is completely possible, via the transmitting sensors; (2) Since there are three rails in one line instead of one rail, this system 100 is well suited for very large and highly populated cities with long traveling distances. When examining the characteristics of the system 100, it could be inferred that for smaller cities only two rails in each line would be sufficient and more economical, while in bigger cities the two-rail design may not be sufficient since the stoppage distances become longer if the maximum speed achievement is not reduced.

For very large and huge cities that would certainly appear in the future time (for example 30 years later) in many countries around the world, the four rails design in each line may work much better and more effectively than three rails design. However, at the present time with existing large cities in the world the two rails and three rails design are sufficient and more economical; (3) Increasing or decreasing the number of cars in a line in service in the loops is possible with much higher number compared to conventional metro systems in the world. If the express system 100 were to be accomplished in a mega city, this system 100 divides the city into smaller transit sections so that in each of these smaller sections, transportation can be provided by conventional metro, buses or taxis. These smaller sections can be connected in high speed with the use of system 100 to provide faster with higher capacity advantages.

These advantages will prevent people from using personal vehicles in cities. Actual experiences in transportation by metro in large cities have shown that with increasing the accomplished projects of metro and increasing the service metro lines in the city; the positive reception of passengers to the metro increases and more passengers want to use it instead of using their own cars. This is a fortune outcome from the air pollution view point in large cities. Even in some cases, it is seen that the crowding of passengers appears sometimes during the working hours of the metro in large cities with large metro networks and large number of metro stations that are so close to each other. The system 100 may operate at more than three times the speed in respect to conventional metro, and provides the conditions for higher passenger capacity on each rail of metro in order to resolve crowded conditions.

In regards to capacity, it is obvious that in comparison with a regular metro system, the present invention could operate many more cars in service. In reality, in a regular metro system as a result of security and safety reasons, it is not possible to make the timing distance of the cars too close to one another, therefore, impossible to operate an additional number of cars. However, the present invention does not have this limitation and enough cars could be added to even the full distance of the line. Further, all the cars in each rail could be connected; therefore, its capacity is over six times more than that of the highest capacity metro lines available in the world today. A simple calculation demonstrates for each km of this system 100, at the condition of full capacity of cars, has a capacity of executing more than 900 thousand round-trips per day for transporting passengers. For example, a twenty-five km line could transport more than 20,000,000 passengers with no waiting time, overcrowding or without reduction in speed.

Although this amount of capacity even at the busiest time and in the most populated cities may never be needed, this system 100 could guarantee that additional cars could be added to any required capacity at any specified time to prevent overcrowding. At present time, in large and populated cities of the world, they are using very reliable and efficient metro systems. However, even with the addition of cars up to the maximum capacity with the shorter time distances between cars, it can be seen that these systems are still overcrowded in cars and stations. This makes the use of the present invention in large cities inevitable, especially in cities that are experiencing growth in both area and population often need a metro system that operates at fast speed over longer distances in order to discourage people from using personal vehicles.

Application of the present invention in conjunction with existing metro or bus in large cities in sizes such as Tehran or Beijing or equally highly populated cities would reduce both pollution and traffic in a large amount. Additionally, it cannot be assumed, the Express system 100 could completely replace the currently used conventional public transportation networks like buses, taxis, since this system 100 is not for reaching to every corner of a city as regular metro, bus or taxi. That is, current modes of transportation must be used in order to reach far away neighborhoods and outlying areas with respect to the system 100. Metro, buses and taxis could be utilized, in conjunction with the present invention, within the zones divided by the system 100, as well as for connecting neighborhood divided areas.

According to the present invention, the system 100 is configured to provide the following advantages: (1) passengers could travel in a desired speed during their travel distance; (2) passengers who want to travel far distances in very populated cities, their travel speed could exceed beyond the speeds on highways; (3) passenger access to the cars is distributed all over the platform, which is extended along the inner rail loop and the distances between car stoppages are adjustable and almost less than that of existing metro systems. For example, a simple calculation for the selected speeds in FIG. 2 reveals that the distance between stoppages of cars is 500 m, while in the existing metro systems it is almost over 1000 m. However, the stoppages distance is adjustable and controllable by adjusting the speed of cars.

For example, if the speed ranges of cars in the loops are selected as 0 to 20, 20 to 70 and 70 to 120 km per hour, then the stoppage distances reduce to 333 m; about one third of 1000 m; (4) application of passenger displacing moving-floors decreases a little bit from the cars capacity in passenger handling. However, from safety points of view, appearance of crowds of passengers is not tolerable in the present invention, as is in the conventional existing metro systems. This would reduce the capacity of passenger handling of the cars. But, on the other hand, the increased average speed of the cars acts as a compensation regarding this matter; (5) in some working hour times of the present invention there may appear conditions that some of the cars need be stopped due to reduction of the number of passengers.

In such conditions, one or two of the triple rail loops can be used in a stopped-open door condition. One may consider two cases as: (a) One of the loop cars are stopped, in this case, the cars in the inner loop (low speed loop) are stopped with their doors opened from both sides. The intermediate loop works in a stop-start condition in place of the inner loop and the other one operates for increasing speed. Thus, the embarking and disembarking passengers have access to the middle loop cars after passing through the stopped cars in the inner loop; (b) Two of the loop cars are stopped, in this case, the cars in the inner loop, as well as the cars in the middle loop, are stopped beside each other with their doors opened for the passengers to access the cars in the outer loop. In this case the outer high-speed loop works as the inner low speed loop for embarking and disembarking of passengers.

According to the present invention, advantages of the present invention in comparison to the conventional metro system are disclosed as follows: (1) passengers could travel in a highly populated city at high speed (up to many times of that of conventional metro systems), without wasting time for embarking and disembarking of other passengers; (2) maximization of the capacity of transporting passengers up to about many times of that of conventional metro system on each rail; (3) possibility for the passengers to travel at high speeds, for example, more than 120 km/h or more, in long distances; (4) transfer of passengers between lines at high speeds without embarking and disembarking; (5) high speed access of passengers to the various regions of city; (6) any increase of population and appearance of crowd of passengers can be resolved by increasing the number of cars in the line without saturation limit and without need to add new lines to the network of the present invention; (7) possibility to add new lines to the existing express system 100 and extend it after increasing the population and the area of city in the future times; (8) group displacing of the passengers between the moving cars on two adjacent rail loops for prevention of accidents using moving floors; (9) perfect air sealing of doors during time of passenger displacement between the moving cars on two adjacent rail loops; (10) possibility to design the network of the present invention in two, three or four rail loops in accordance to the city population and area, for adjusting the maximum speed in the high speed loops and the minimum station distance; (11) possibility to connect the express transit system 100 of two nearby cities in an express manner such the whole networks serve as a unified network; and (12) possibility to stop continually one or two rail loops in low crowded passenger times for prevention of excessive power consumption.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions.

Although specific terms may be employed herein, they are used only in generic and descriptive sense and not for purposes of limitation. Accordingly, the present invention is not limited to the specific embodiments illustrated herein. While the above is a complete description of the preferred embodiments of the invention, various alternatives, modifications, and equivalents may be used. Therefore, the above description and the examples should not be taken as limiting the scope of the invention, which is defined by the appended claims.

What is claimed:

1. A multi-rail express transit system, comprising:

a centralized control system;

at least three closed loop parallel rails, and at least three sequences of transit cars, wherein each sequence of transit car is supported by a respective one of the parallel rails, wherein the at least three sequences of transit cars are configured to move in same direction at different speeds, wherein the centralized control system is configured to synchronize the speed of at least two sequences of transit cars at a desired point to allow transference of one or more passengers between the at least two sequences of transit cars, wherein each transit car comprises a digital device in communication with the centralized control system, wherein the digital device is configured to display and announce a location information of passengers, time to start changing transit cars, and allow passengers to select their desired stop.

2. A multi-rail express transit system, comprising:

a centralized control system;

at least three closed loop parallel rails, and at least three sequences of transit cars, wherein each sequence of transit car is supported by a respective one of the parallel rails, wherein the at least three sequences of transit cars are configured to move in same direction at different speeds, wherein the centralized control system is configured to synchronize the speed of at least two sequences of transit cars at a desired point to allow transference of one or more passengers between the at least two sequences of transit cars, wherein the centralized control system is configured to:

clamp a bellow sealing member of at least one transit car to at least one adjacent transit car using a magnetic clamp to form an airtight passageway;

open a door of the at least one transit car and the adjacent transit car;

extend a movable floor of the at least one transit car to a floor of the adjacent transit car for a transference of passengers, retract the movable floor to the at least one transit car and closes the door of the at least one transit car and the adjacent transit car, after transference of passengers, and retract a bellow assembly to a compact position using a bellow expander.

3. A multi-rail express transit system, comprising:

a centralized control system;

at least three closed loop parallel rails;

at least three sequences of transit cars are configured to move in same direction at different speeds, wherein each sequence of transit car is supported by a respective one of the parallel rails, and a bellow assembly disposed around an exterior side of a door of each transit car, wherein the bellow assembly is in communication with the centralized control system, wherein the bellow assembly comprises a bellow sealing member, a magnetic clamp and a bellow expander operated using two or more hydraulic actuators, wherein the centralized control system is configured to:

synchronize the speed of at least two sequences of transit cars at a desired point to allow transference of one or more passengers;

clamp the bellow sealing member of at least one transit car to at least one adjacent transit car using the magnetic clamp to form an airtight passageway therebetween;

open a door of the at least one transit car and the adjacent transit car;

extend a movable floor of the at least one transit car to a floor of the adjacent transit car for the transference of passengers;

retract the movable floor to the at least one transit car and closes the door of the at least one transit car and the adjacent transit car, after transference of passengers, and retract the bellow assembly to a compact position using the bellow expander.

* * * * *